US011357280B2

(12) United States Patent
Sanchez

(10) Patent No.: US 11,357,280 B2
(45) Date of Patent: Jun. 14, 2022

(54) SAFETY HELMET AND ACCESSORY SYSTEM THAT PREVENTS HEARING LOSS AT WORKSITES

(71) Applicant: Macario Sanchez, Miami, FL (US)

(72) Inventor: Macario Sanchez, Miami, FL (US)

( * ) Notice: Subject to any disclaimer, the term of this patent is extended or adjusted under 35 U.S.C. 154(b) by 405 days.

(21) Appl. No.: 16/287,821

(22) Filed: Feb. 27, 2019

(65) Prior Publication Data

US 2020/0268088 A1 Aug. 27, 2020

(51) Int. Cl.
*A42B 3/16* (2006.01)
*A42B 3/04* (2006.01)

(52) U.S. Cl.
CPC ..... *A42B 3/16* (2013.01); *A42B 3/0406* (2013.01)

(58) Field of Classification Search
CPC .. A42B 3/16; A42B 3/166; A42B 3/04; A42B 3/0406; A42B 1/24; A42B 1/245; A61F 11/08; A61F 11/12
USPC ..... 2/422
See application file for complete search history.

(56) References Cited

U.S. PATENT DOCUMENTS 3,721,993 A * 3/1973 Lonnstedt ..... A42B 3/166 2/423
3,797,040 A * 3/1974 Caldwell ..... A42B 3/166 2/421
3,871,372 A * 3/1975 Bivins ..... A61F 9/029 128/866
3,970,082 A * 7/1976 Leight ..... A42B 3/166 128/866
4,276,657 A * 7/1981 Montesi ..... A42B 3/185 2/10
5,074,375 A * 12/1991 Grozil ..... A61F 11/12 181/135
5,193,226 A * 3/1993 Mortenson ..... A42B 3/0406 2/422
5,581,821 A * 12/1996 Nakano ..... A42B 3/166 128/866
5,988,313 A * 11/1999 Håkansson ..... B29C 45/1676 181/135
6,427,800 B1 * 8/2002 Hiselius ..... A61F 11/08 128/864
6,467,097 B1 * 10/2002 Kutner ..... A42B 1/24 2/195.1
7,519,192 B1 * 4/2009 Laycock ..... A41D 1/005 381/301
7,974,432 B1 * 7/2011 Ryan ..... H04R 5/033 381/388
2002/0186180 A1 * 12/2002 Duda ..... H04L 67/04 345/8

(Continued)

*Primary Examiner* — Heather Mangine

(57) ABSTRACT

A safety helmet and accessory system for construction worksites. The system includes a safety helmet that defines two apertures, each aperture being positioned on the helmet so that they will correspond to a user's left and right ears when the safety helmet is placed on the user's head, the safety helmet has a plurality of cord holder attachments attached within an inner circumference of the safety helmet. A pair of capsules, each capsule is secured within each aperture of the safety helmet. A cord that has two terminal ends and each terminal end has a securing device. And, a pair of earplugs that define a stem, the stem of each ear plug has a receiver that receives each securing device. The system provides a safety helmet that has an integral earplug securing system.

5 Claims, 7 Drawing Sheets

(56) References Cited

U.S. PATENT DOCUMENTS

2003/0079935 A1* 5/2003 Weise ..... A61F 11/08 181/129
2004/0025230 A1* 2/2004 Rainey ..... A42B 3/30 2/422
2006/0057972 A1* 3/2006 Wikel ..... A42B 3/30 455/90.3
2006/0182270 A1* 8/2006 Burns ..... A42B 1/245 379/430
2007/0147628 A1* 6/2007 Benway ..... H04R 1/1083 381/71.2
2007/0226876 A1* 10/2007 Foust ..... A42B 1/245 2/171
2008/0025524 A1* 1/2008 Vaudrey ..... A61F 11/14 381/72
2009/0144884 A1* 6/2009 Duncan ..... A62B 17/04 2/410
2009/0175482 A1* 7/2009 Crutcher ..... H04R 1/1033 381/376
2009/0199322 A1* 8/2009 Parrish ..... A42B 3/04 2/209.13
2009/0199326 A1* 8/2009 Brauner ..... A61F 11/12 2/423
2009/0208040 A1* 8/2009 Planansky ..... A42B 1/245 381/301
2009/0210995 A1* 8/2009 Kwon ..... A42B 1/245 2/209.13
2011/0000941 A1* 1/2011 Volk ..... A42B 1/241 224/181
2011/0113529 A1* 5/2011 Milioto ..... F16B 2/20 2/209.13
2011/0116673 A1* 5/2011 Lewis ..... H04B 1/385 381/376
2011/0129110 A1* 6/2011 Wolfe ..... H04R 1/028 381/333
2012/0073583 A1* 3/2012 Turdjian ..... A61F 11/08 128/864
2013/0160187 A1* 6/2013 Crutcher ..... A42B 1/245 2/181
2015/0289048 A1* 10/2015 Schermerhorn ..... H04R 1/1091 381/376
2016/0183620 A1* 6/2016 Moreau ..... A44B 13/0029 2/421
2016/0203663 A1* 7/2016 Proctor ..... F21V 33/0008 345/8
2016/0242483 A1* 8/2016 Dorsey ..... A42B 3/0406
2016/0286943 A1* 10/2016 Andersen ..... A61F 11/12
2018/0250168 A1* 9/2018 Herring ..... H04R 5/033
2019/0364988 A1* 12/2019 Driessen ..... A61F 11/12

* cited by examiner

SAFETY HELMET AND ACCESSORY SYSTEM THAT PREVENTS HEARING LOSS AT WORKSITES

BACKGROUND

The present invention is directed to a safety helmet and accessory system that prevents hearing loss at construction worksites.

OSHA ("The Occupational Safety and Health Administration") states "Protective equipment, including personal protective equipment for eyes, face, and head, and extremities, protective shields and barriers, shall be provided, used, and maintained . . . wherever it is necessary by reason of hazards of processes or environment, chemical hazards, radiological hazards, or mechanical irritants encountered in a manner capable of causing injury or impairment in the function of any part of the body through . . . physical contact."[1]

[1]Available at OSHA official website, United States Department of Labor, Standard Interpretations 2004-11-17: Determining the need for hard hat and eye protection on construction sites.

OSHA further states "The Occupational Noise Exposure Standard (1910.95) requires the employer to provide hearing protectors to all general industry employees exposed to an 8-hour TWA of 85 decibels at no cost to the employees. This requirement is explicit in the noise standard. The issues being addressed in the proposed revision of 1910.132 for personal protection equipment would not affect or in any way change provisions in existing OSHA standards that address who is to pay for particular PPE (e.g., respirators in health standards)."[2]

[2] Available at OSHA official website, Unites States Department of Labor, Standard Interpretations 2000-10-02: Hearing protection and the responsibility for paying for the hearing protectors including replacement devices/parts.

Hearing protectors must be replaced as necessary[3]. Ear plugs have a limited life span, for they lose their elasticity with time[4].

[3]Id.

[4]Id.

OSHA further states that "although some foam plugs can be washed several times in mild soap and water, they should usually be changed every day or two, especially in dusty or oily environments. They should not be removed with dirty hands, if they are expected to be reused. Reinsertion of dirty plugs can cause ear infections. Plugs that cannot be cleaned must be replaced."[5]

[5]Id.

The inventor of the present invention works in the construction industry and experienced some hearing loss or discomfort due to noise that is generated at construction worksites.

At the worksites he has been given earmuffs and earplugs to work at sites. He does not find earmuffs comfortable to wear at some work sites and when given earplugs he has often lost them throughout the course of an 8-hour workday.

A problem that he encounters when given ear plugs at worksites is that they get contaminated with other substances when not is use. Once contaminated, if he uses the earplugs, he runs the danger of contracting an ear infection. So often he chooses not to reinsert the earplugs, thereby causing injury to his ears.

For the foregoing reason there is a need for a safety helmet and accessory system that prevents hearing loss when used at construction worksites.

SUMMARY

The present invention describes a safety helmet and accessory system that will prevent hearing loss at construction worksites.

The safety helmet and accessory system includes a safety helmet that defines two apertures, each aperture being positioned on the helmet so that they will correspond to a user's left and right ears when the safety helmet is placed on the user's head, the safety helmet has a plurality of cord holder attachments attached within an inner circumference of the safety helmet. A pair of capsules, each capsule is secured within each aperture of the safety helmet. A cord that has two terminal ends and each terminal end has a securing device. And, a pair of earplugs that define a stem, the stem of each ear plug has a receiver that receives each securing device. The system provides a safety helmet that has an integral earplug securing system.

Each capsule defines a flap that is used to cover each capsule when the earplugs are not inserted within the capsules.

The safety helmet and securing system is used by placing the safety helmet on a user's head. Then taking the earplugs out of the capsules of the safety helmet. Covering the capsules with each flap. Inserting each earplug within each ear of the user.

An object of the present invention is to provide a safety helmet and accessory system that will prevent earplugs from being contaminated at worksites.

Another object of the present invention is to provide a safety helmet and accessory system that will prevent earplugs from getting lost when not in use.

Yet another object of the present invention is to provide an easy manner of replacing the earplugs that are connected to the safety helmet and accessory system.

DRAWINGS

These and other features, aspects, and advantages of the present invention will become better understood with regards to the following description, appended claims, and drawings where:

Figure 1:
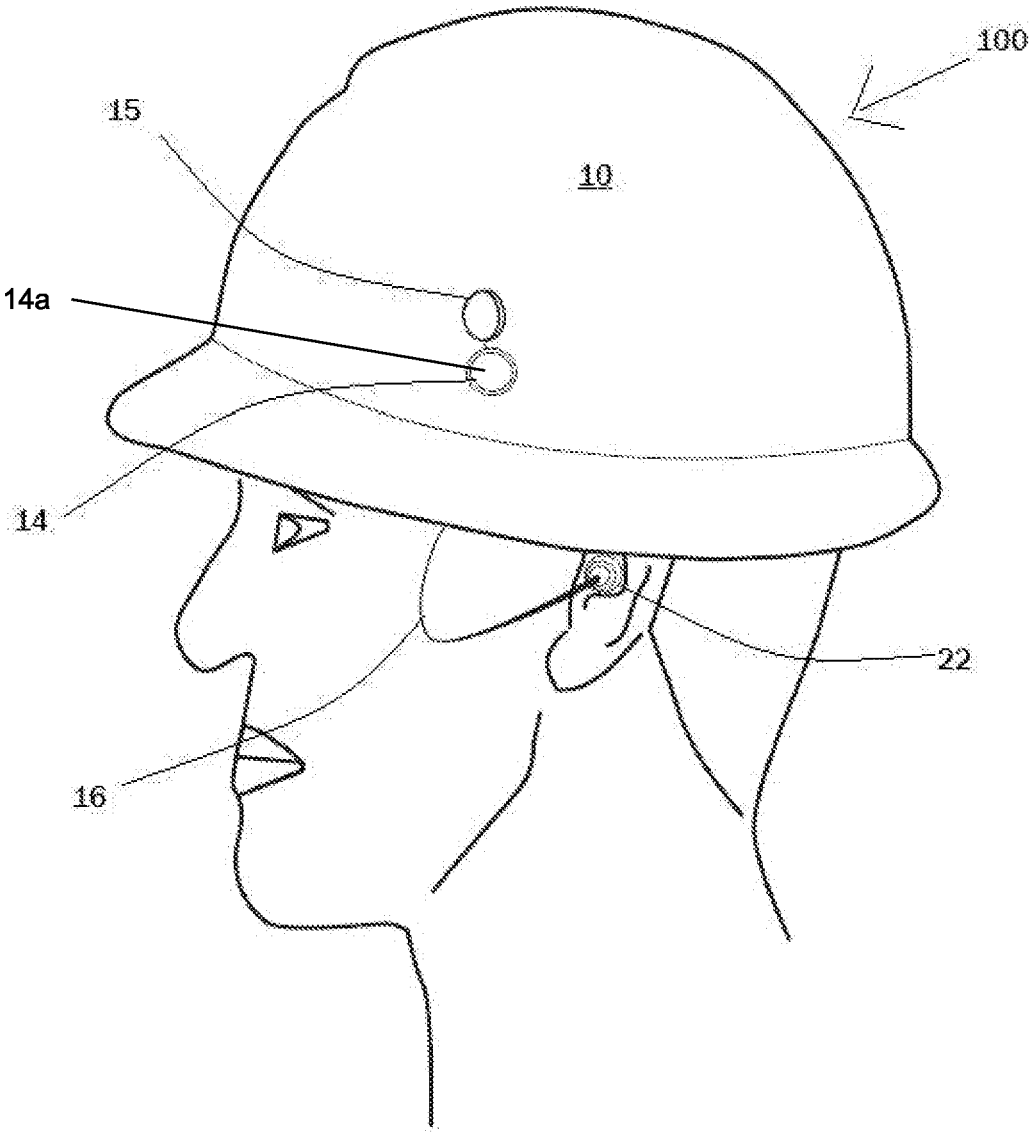
FIG. 1 is a side view of the present invention on the head of a user.
Figure 2:
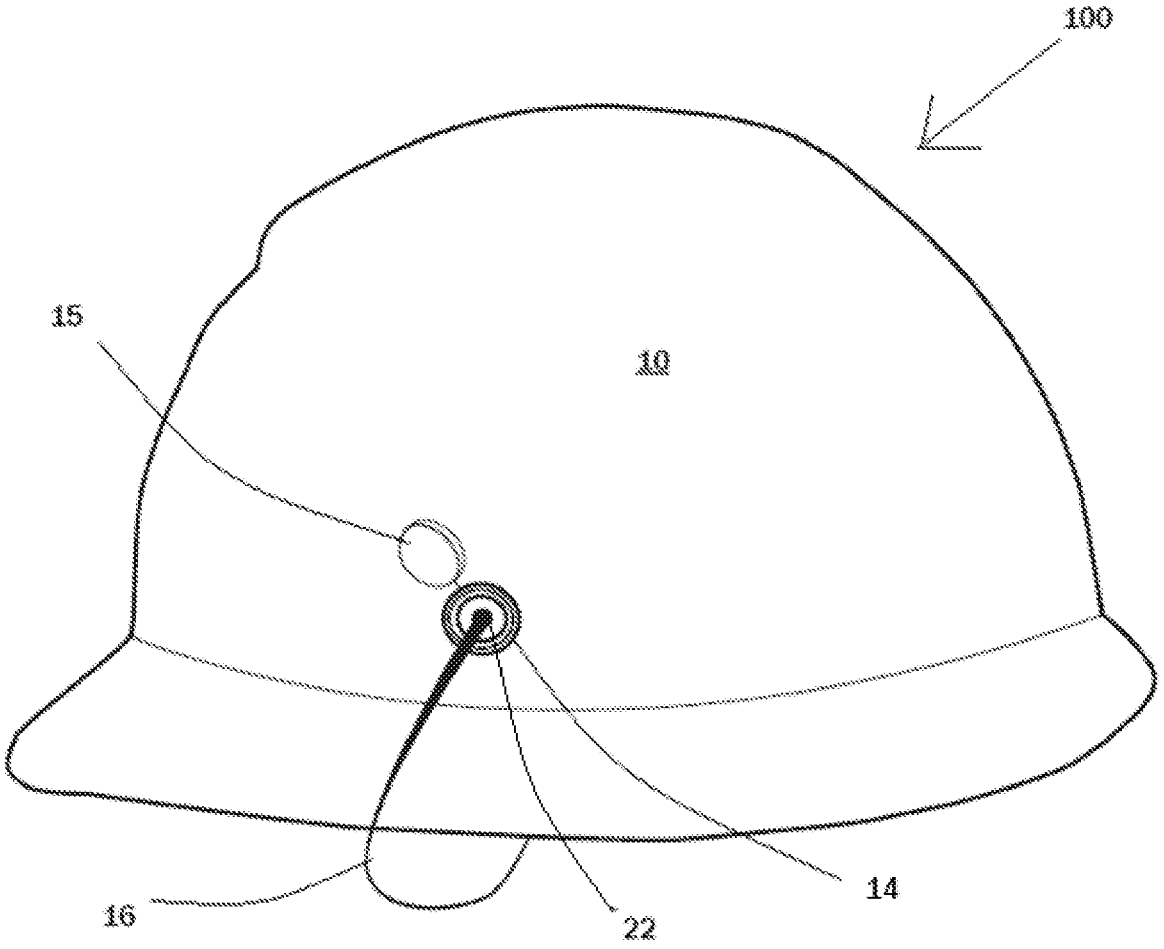
FIG. 2 is a side view of the present invention showing the earplug within the capsule of the safety helmet.
Figure 3A:
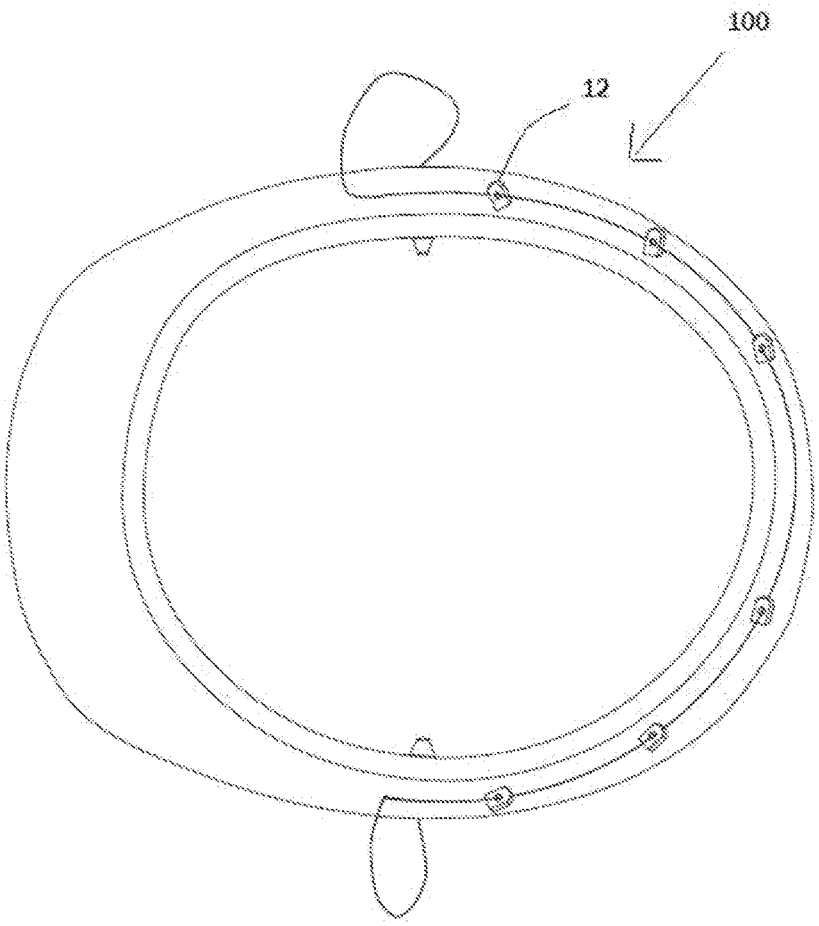
Figure 3B:
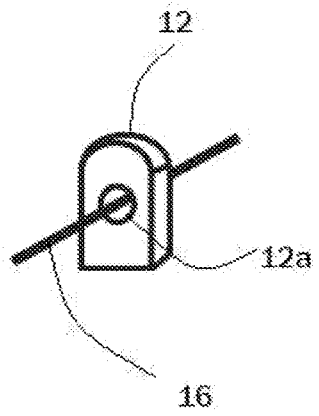
Figure 4:
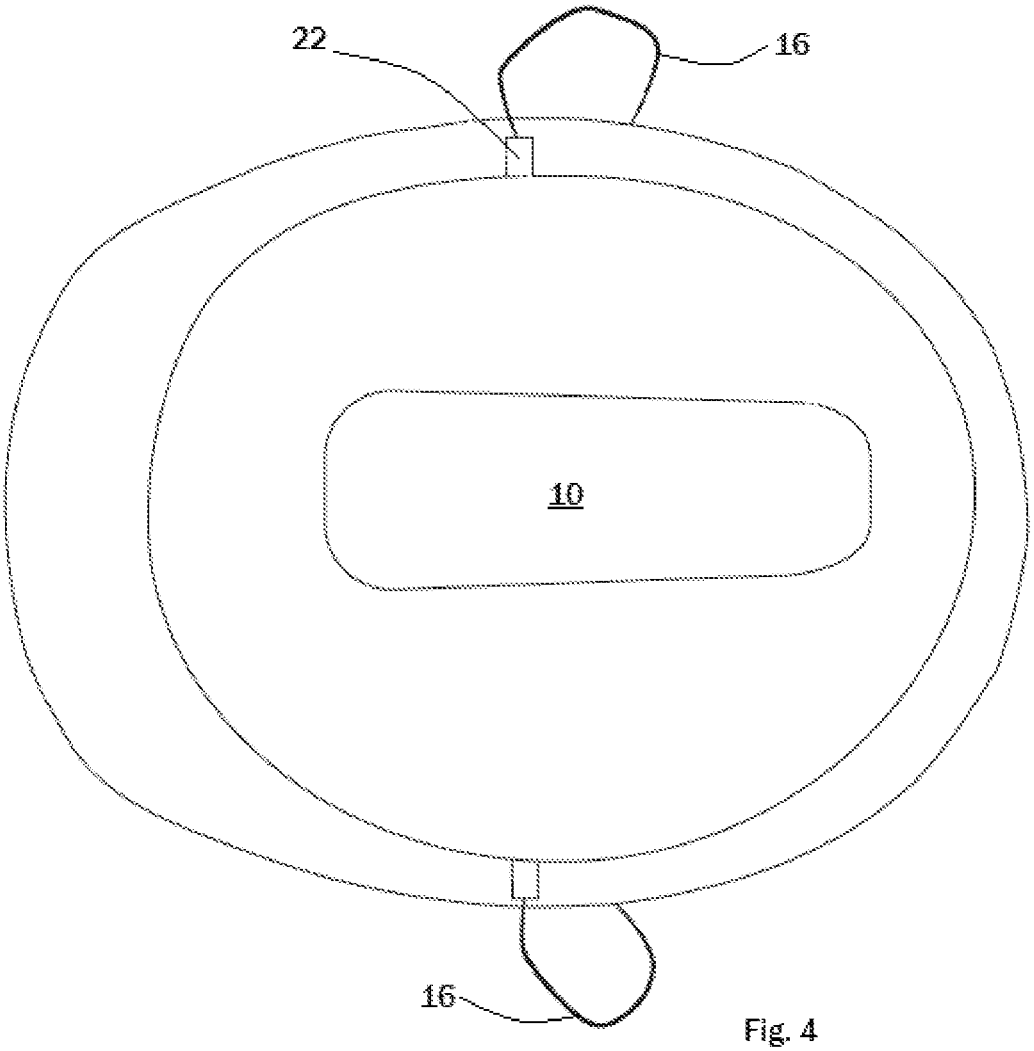
Figure 5:
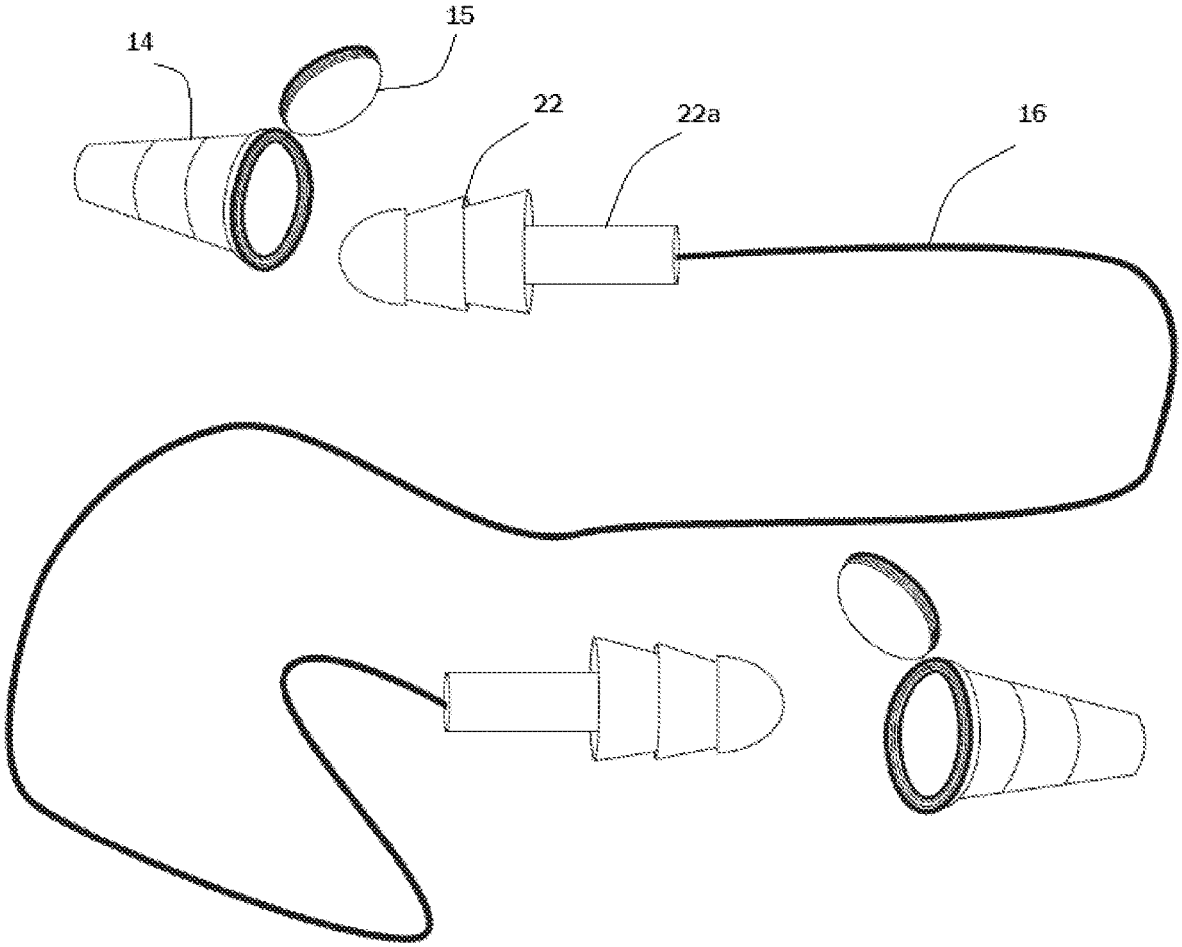
Figure 6:
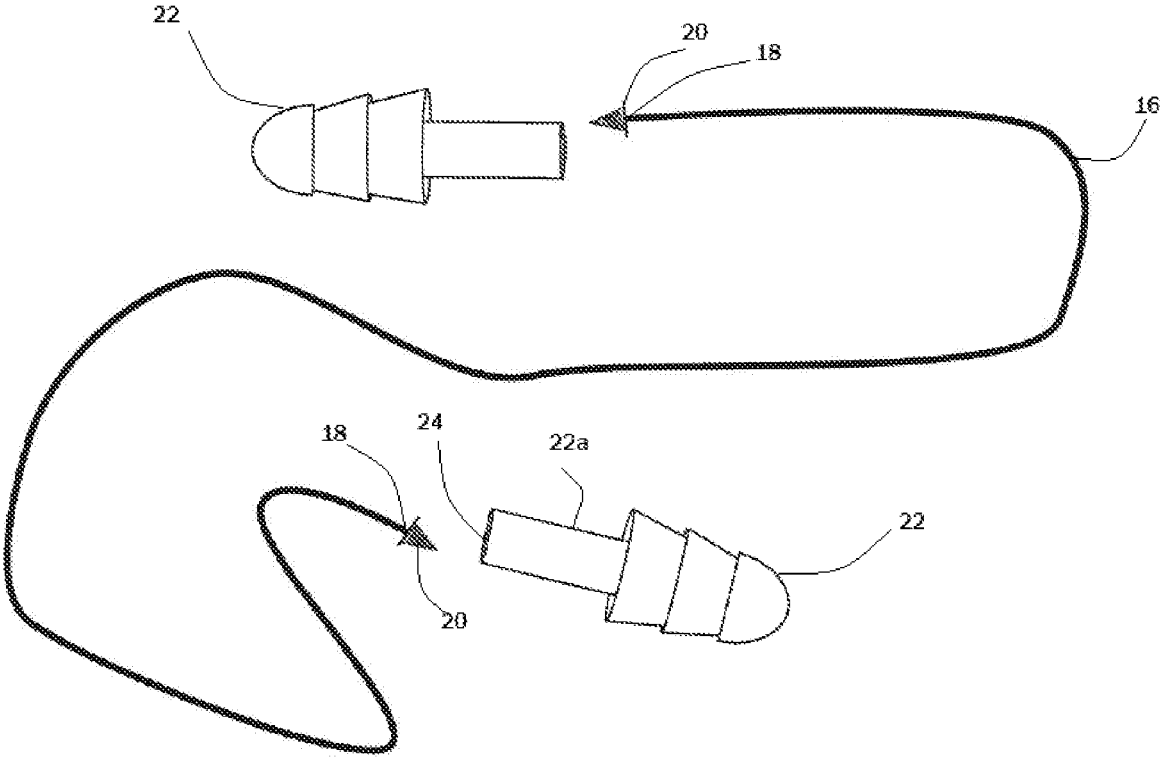
Figure 7:
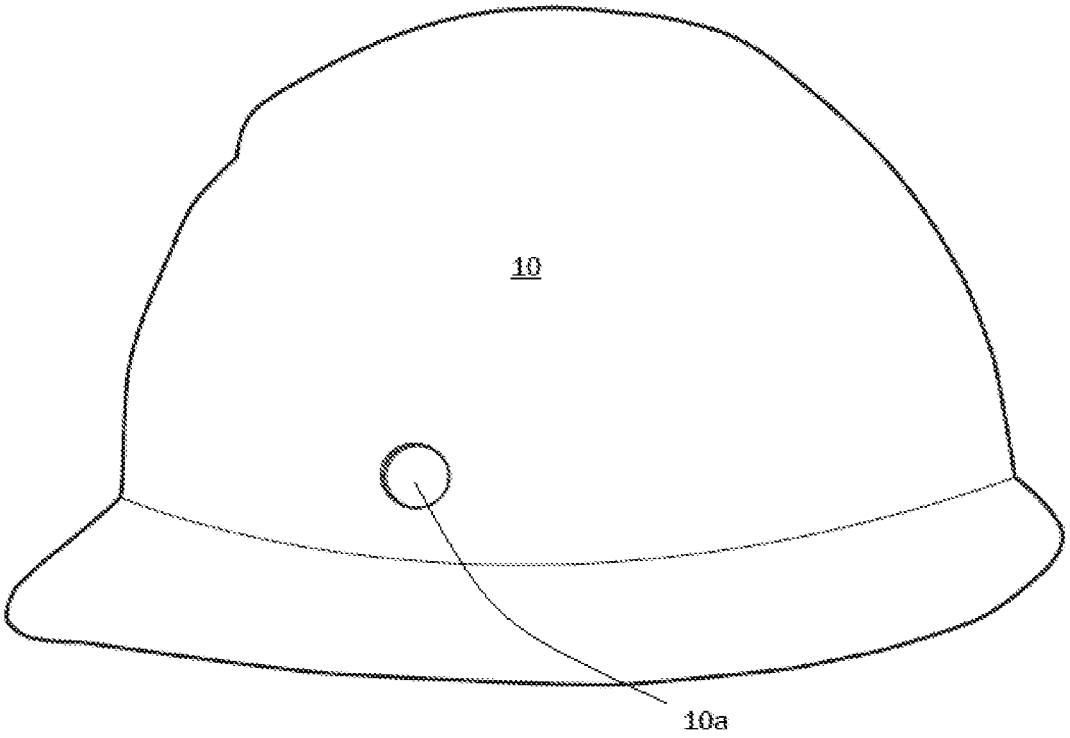

FIG. 3*a* is a bottom plan view of the present invention that shows the plurality of cord attachments;

FIG. 3*b* shows how the cord is inserted and passed though the cord attachments;

FIG. 4 is a top plan view of the present invention that shows the earplugs inserted within the capsules;

FIG. 5 is an isometric view that shows the capsule, earplug and cord system of the present invention;

FIG. 6 is an isometric view that shows how the securing device of each terminal end of the cord are attached to the receiver of each earplug; and FIG. 7 is a side view that shows the aperture of the safety helmet wherein the capsules are inserted.

DESCRIPTION

As seen in FIGS. 1-7, the present invention describes a safety helmet and accessory system 100 for construction worksites. The safety helmet and accessory system 100 comprises a safety helmet 10 that defines two apertures 10*a*, each aperture 10*a* positioned on the safety helmet 10 so that they will correspond to a user's left and right ears when the safety helmet 10 is placed on the user's head, the safety helmet 10 has a plurality of cord holder attachments 12 attached within an inner circumference of the safety helmet 10. A pair of capsules 14, each capsule 14 is secured within each aperture 10*a* of the safety helmet 10. A cord 16 that has two terminal ends 18 and each terminal end 18 defines a securing device 20. And, a pair of earplugs 22 that define a stem 22*a*, the stem 22*a* of each ear plug 22 has a receiver 24 that receives each securing device 20. In a preferred embodiment, the securing device 20 will screw in to the receiver 24.

In the preferred embodiment. The capsules 14 define a pair of flaps 15 and each flap 15 is designed to cover an opening 14*a* of each capsule 14. Ideally, each capsule 14 is conically shaped.

The earplugs 22 can be made of an elastic material or silicone.

The cord 16 can be made of an elastic material. In a preferred embodiment, the cord 16 will be made of silicone.

In the preferred embodiment, each cord holder attachment 12 defines a through hole 12*a* wherein the cord 16 in passed through.

An advantage of the present invention is that it provides a safety helmet and accessory system that prevents earplugs from being contaminated at worksites.

Another advantage of the present invention is that it provides a safety helmet and accessory system that prevents earplugs from getting lost when not in use.

Yet another advantage of the present invention is that it provides an easy manner of replacing the earplugs that are connected to the safety helmet and accessory system.

While the inventor's above description contains many specificities, these should not be construed as limitations on the scope, but rather as an exemplification of several preferred embodiments thereof. Accordingly, the scope should not be determined by the embodiments illustrated, but by the appended claims and their legal equivalents.

What is claimed is:

1. A safety helmet and accessory system for construction worksites, comprises:

the safety helmet that defines two apertures, a first aperture of the two apertures being positioned on the helmet so that they first aperture corresponds to a user's left ear when the safety helmet is placed on the user's head, and a second aperture of the two apertures being positioned on the helmet so that the second aperture corresponds to the user's right ear when the safety helmet is placed on the user's head, the safety helmet has a plurality of cord holder attachments attached within an inner circumference of the safety helmet;

a pair of capsules, wherein a first capsule of the pair of capsules is secured within the first aperture of the safety helmet, and wherein a second capsule of the pair of capsules is secured within the second aperture of the safety helmet;

a cord that has two terminal ends and each terminal end of the terminal ends has a securing device; and a pair of earplugs that define a stem, the stem of each ear plug has a receiver that receives each securing device wherein each capsule of the pair capsules is configured to receive and hold a corresponding earplug of the pair of earplugs when the corresponding earplug is not in use to prevent contamination of the earplugs.

2. The safety helmet and accessory system for construction worksites of claim 1, comprises pair of flaps, wherein a first flap of the pair of flaps is attached to the first capsule, and wherein a second flap of the pair of flaps is attached to the second capsule, and each flap is designed to cover a respective opening of the capsule to which it is attached.

3. The safety helmet and accessory system for construction worksites of claim 2, wherein each capsule of the pair of capsules is conical.

4. The safety helmet and accessory system for construction worksites of claim 1, wherein the cord is made of an elastic material.

5. The safety helmet and accessory system for construction worksites of claim 1, wherein each cord holder attachment defines a through hole wherein the cord is passed through.

* * * * *